United States Patent [19]

Wallace et al.

[11] 4,152,223

[45] May 1, 1979

[54] PLASMA SPRAYED MCrAlY COATING AND COATING METHOD

[75] Inventors: Francis J. Wallace, Windsor; Norman S. Bornstein, West Hartford; Michael A. DeCrescente, Wethersfield, all of Conn.

[73] Assignee: United Technologies Corporation, Hartford, Conn.

[21] Appl. No.: 815,612

[22] Filed: Jul. 13, 1977

[51] Int. Cl.[2] ..... C25D 5/48; B05D 1/08

[52] U.S. Cl. ..... 204/37 R; 204/35 N; 204/38 B; 427/34; 427/383 D; 427/405; 428/667; 428/668

[58] Field of Search ..... 204/35 R, 204/38 B, 37 R; 427/34, 367, 377, 383 D, 405; 428/667, 668, 652; 148/4

[56] References Cited

U.S. PATENT DOCUMENTS

| | | | |
|---|---|---|---|
| 3,676,085 | 7/1972 | Evans et al. | 428/668 |
| 3,866,301 | 2/1975 | Salsgiver | 29/412 |
| 3,961,098 | 6/1976 | Bessen | 427/34 |

OTHER PUBLICATIONS

D. B. Arnold et al., "Process for High-Integrity Casting", Air Force Materials Lab, Air Force Systems Command, Wright-Patterson; IR-162-2(II), Nov. 1972.

Lou Frost, New Manufacturing Process & Techniques, Memo 33; North American Rockwell Aerospace & Systems Group.

*Primary Examiner*—T. Tung
*Assistant Examiner*—William Leader
*Attorney, Agent, or Firm*—Edward J. Timmer; Charles G. Nessler

[57] ABSTRACT

The oxidation-corrosion resistance of plasma sprayed MCrAlY overlay coatings is improved. The coating method involves plasma spraying the MCrAlY coating alloy onto a superalloy substrate, applying a chromium or aluminum envelope over the outer surface of the coating or mechanically working the outer surface to seal the surface against penetration by the high pressure isostatic atmosphere to be subsequently applied and then hot isostatically pressing the coated substrate to close the coating defects and diffuse at least a portion of the envelope, if present, into the overlay coating. The invention thus can provide an MCrAlY coating not only substantially free of pores, voids and the like defects but also having at least an outer zone enriched in chromium, aluminum or like metals.

6 Claims, 4 Drawing Figures

PLASMA SPRAYED MCRALY COATING AND COATING METHOD

BACKGROUND OF THE INVENTION

1. Field of the Invention

The present invention relates to high temperature coatings of the MCrAlY type and their application to superalloy substrates, particularly by plasma spray techniques.

2. Description of the Prior Art

It is well known that the family of high temperature, oxidation-corrosion resistant coatings commonly referred to as MCrAlY coatings can markedly extend the service life of gas turbine blades, vanes and like components; for example, see U.S. Patents to Evans et al. U.S. Pat. No. 3,676,085; Goward et al. U.S. Pat. No. 3,754,903 and Talboom Jr. et al. U.S. Pat. No. 3,542,530, all of which are of common assignee with the present invention. The MCrAlY coatings are referred to as overlay coatings denoting the fact that they are deposited on the substrate as an alloy and act substantially independently of the substrate in providing oxidation-corrosion protection.

In the past, these coatings have been applied to superalloy substrates by vacuum vapor deposition, sputtering and plasma spraying techniques. Of the three, plasma spraying exhibits greatest versatility in manufacturing operations. However, in plasma spraying MCrAlY coating alloys on superalloy substrates, the prior art has experienced less than satisfactory results due to the development of interconnected as well as isolated pores, voids and like defects in the coating, some of which extend to and penetrate the outer or free surface of the coating. It has been observed that such defects adversely affect the oxidation-corrosion resistance of MCrAlY coatings, for example, as compared to that of similar vapor deposited coatings.

SUMMARY OF THE INVENTION

Accordingly, the present invention has as one of its object a plasma spray coated superalloy article and method for coating same wherein the MCrAlY overlay coating is characterized as being substantially free of pores, voids and like defects internally and at the free surface thereof. Another object of the invention is to provide a plasma sprayed MCrAlY coating having oxidation-corrosion resistance at least comparable to that of vapor deposited coatings of the same composition.

The method of the present invention typically envisions (a) plasma spraying an MCrAlY coating alloy onto the superalloy substrate, the coating having the aforementioned defects usually associated with that coating technique, (b) sealing the outer or free surface of the MCrAlY coating to prevent penetration of the high pressure isostatic atmosphere to be subsequently applied, and (c) hot isostatically pressing the coated substrate to close and collapse the coating defects, thereby improving the protective ability of the coating. In one preferred version, sealing of the outer surface of the plasma sprayed coating is effected by peening with fine glass frit. In another preferred version, sealing of the outer or free coating surface is effected by providing a metallic envelope thereon, the envelope preferably comprising a metal, such as chromium, aluminum and the like, having the ability to enhance the oxidation-corrosion resistance of the MCrAlY coating. During hot isostatic pressing, a portion, preferably all, of such metallic envelope is diffused into the overlay coating to provide at least an outer zone enriched in chromium, aluminum and the like which, in combination with the substantial absence of coating defects, results in a significantly improved plasma sprayed MCrAlY overlay coating.

These and other objects and advantages of the present invention will become more apparent from the following description of the drawings and preferred embodiment.

DESCRIPTION OF THE PREFERRED EMBODIMENT

Although the exemplary embodiment of the invention set forth in detail hereinbelow relates to a plasma sprayed CoCrAlY overlay coating on a nickel base superalloy substrate, it is offered merely for illustration and is not intended to limit the scope of the present invention. The invention has general applicability to the family of high temperature coatings designated MCrAlY overlay coatings wherein M is selected from nickel, cobalt and iron and combinations thereof and to the family of metals and alloys referred to as superalloys including, but not limited to, high strength nickel-base, cobalt-base and iron-base alloys.

Figure 1:
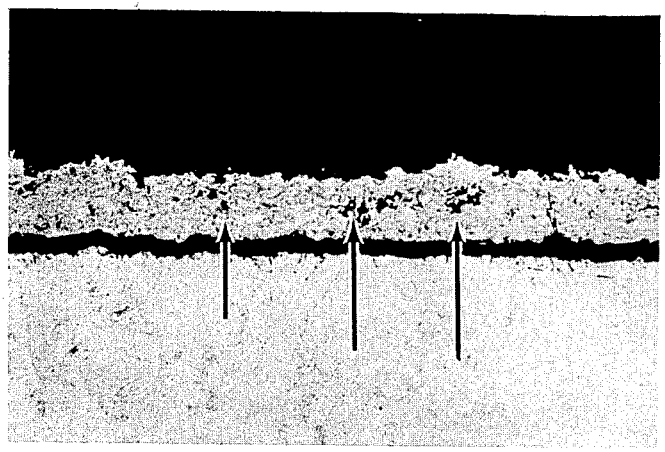
FIG. 1 is a photomicrograph of a plasma sprayed CoCrAlY overlay coating showing defects associated with conventionally applied coatings (100x before reduction).
Figure 2:
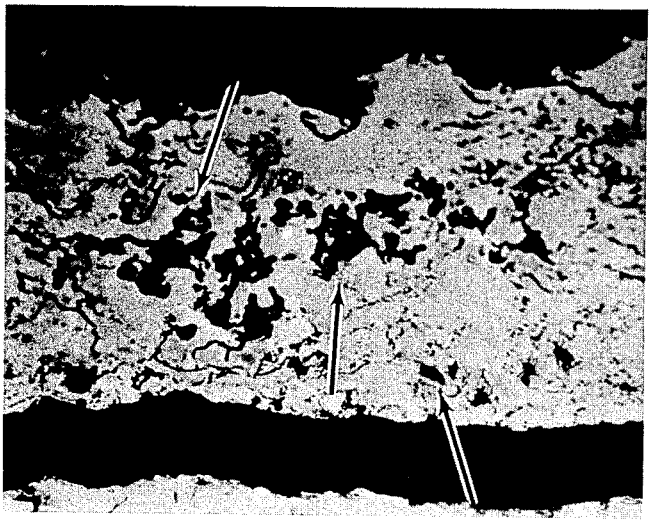
FIG. 2 is a selected portion of FIG. 1 (500x before reduction).

Referring to FIGS. 1 and 2, a CoCrAlY overlay coating of composition, by weight, 65.5% Co, 22.0% Cr, 12.0% Al and 0.5% Y is shown on a nickel base superalloy substrate (the superalloy being commonly known as B-1900 having a nominal composition of 8.0% Cr, 10.0% Co, 1.0% Ti, 6.0% Al, 6.0% Mo, 4.3% Ta, balance essentially nickel) after conventional plasma spraying, such as after spraying with a spray gun designated SG-100 manufactured by Plasmadyne Inc. The separation visible between the overlay coating and the substrate occurred during metallographic preparation and should be ignored. It is apparent from the figures that the conventional plasma sprayed CoCrAlY coating contains numerous pores or voids (arrows), both isolated and interconnected, some of which extend to and penetrate the outer or free surface of the coating, i.e., the coating surface to be exposed to the corrosive environment. Corrosion tests have shown that CoCrAlY overlay coatings of the type shown in FIGS. 1 and 2 are inferior in service life to the same coating applied by vacuum vapor deposition techniques. For example, for the same CoCrAlY coating alloy, the service life of plasma sprayed coatings has been found to be approximately 60% that of vapor deposited coatings in corrosive environments such as sulfidation tests (high temperature $Na_2SO_4$ tests).

The present invention improves the oxidation-corrosion resistance of plasma sprayed MCrAlY overlay coatings by a unique coating method involving a series of steps as set forth immediately below. According to the invention, the nickel base superalloy substrate is plasma sprayed with the CoCrAlY coating alloy in the conventional manner, e.g., with the spray gun designated SG-100 mentioned above. Of course, this overlay coating contains numerous defects in the form of pores or voids, FIGS. 1 and 2, which defects adversely affect the protective ability of the coating. Then, the outer or free surface of the CoCrAlY coating is sealed to prevent penetration of the high pressure isostatic atmosphere to be subsequently applied. In one preferred embodiment of the invention, the outer coating surface is peened or otherwise compressively worked to close the defects which penetrate that surface, thereby providing an outer skin or envelope through which the isostatic atmosphere cannot pass. Glass frit, such as −40 to +80 mesh, has been found to provide suitable sealing action when directed against the outer CoCrAlY coating surface with a force represented by 10N. Of course the peening material and force with which it is directed against the outer surface are adjusted as desired to achieve the proper sealing action.

In another embodiment, the outer or free surface of the CoCrAlY coating is electroplated or otherwise conveniently coated or wrapped to provide a metallic envelope thereon. Although the metallic envelope may be of any metal which is innocuous to the properties of the overlay coating, such as nickel, cobalt and the like, the envelope is preferably formed of chromium, aluminum or other similar metals which enhance the protective properties of the overlay coating. The metallic envelope is applied in such a manner that the envelope spans or bridges the coating defects which penetrate the free surface and seals them against the high pressure atmosphere to be subsequently applied. The thickness of the metallic envelope can be varied as desired from less than 0.1 mil to more than 3 mils. An electro-deposited chromium envelope of 1 mil average thickness has been found suitable for use with the CoCrAlY coating and the nickel base superalloy substrate described above. If a wrapping technique is used, metal foil, for example, aluminum foil, may be satisfactorily used in the invention.

Figure 3:
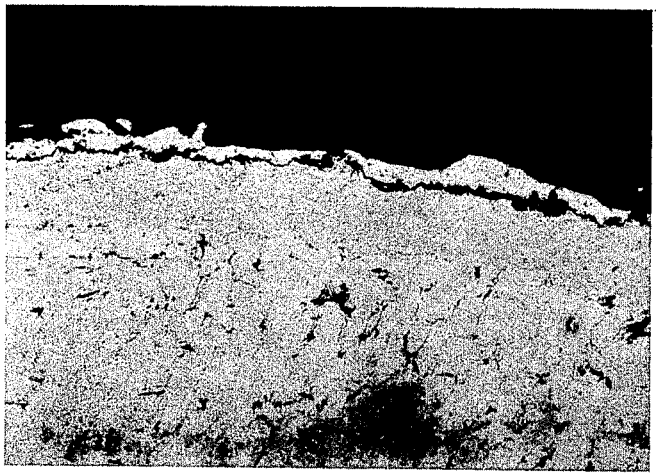
FIG. 3 is a photomicrograph of a plasma sprayed CoCrAlY overlay coating applied in accordance with the invention (100x before reduction).
Figure 4:
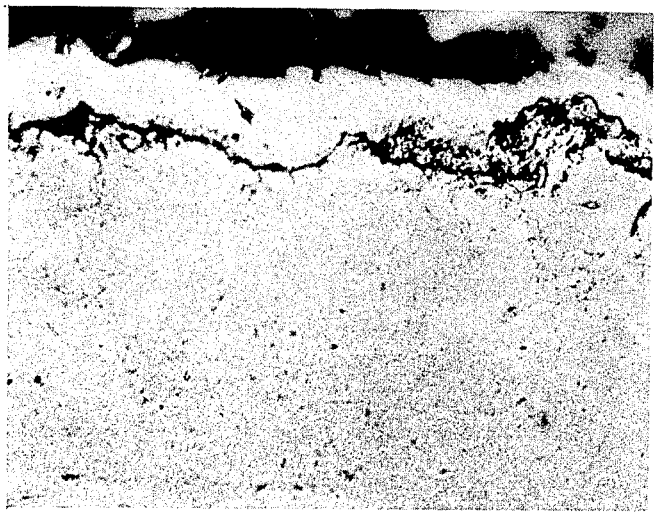
FIG. 4 is a selected portion of FIG. 3 (500x before reduction).

After proper outer surface sealing is achieved, the coated substrate or article is hot isostatically pressed to close the pores, voids and other defects of the CoCrAlY coating. The parameters of hot isostatic pressing can be varied to suit particular needs; times less than one hour to more than five hours, temperatures less than 1600° F. to more than 2100° F. and pressures less than 10 ksi to more than 30 ksi being useful. Preferably, however, if a metallic envelope is utilized, the pressing parameters are sufficient not only to close the pressing parameters are sufficient not only to close the defects in the CoCrAlY coating but also to diffuse at least a portion of the metallic envelope into the overlay coating to further improve its protective properties. Preferably, the entire envelope is diffused into the coating to provide maximum coating protectiveness. For the chromium envelope of 1 mil thickness, hot isostatic pressing for four hours at 1950° F. and 15 ksi was found suitable for closing substantially all the voids or defects associated with the coating and also for diffusing the chromium envelope completely into the outer zone of the coating. The resulting defect-free, chromium enriched CoCrAlY coating is shown in FIGS. 3 and 4. It is apparent from these figures that the CoCrAlY coating is substantially free of pores, voids or other defects and is fully bonded to the superalloy substrate.

If aluminum foil is wrapped or otherwise provided in envelope form on the outer coating surface, the aluminum will melt and diffuse during hot isostatic pressing to form intermetallic compounds with the substrate, for example, NiAl, which compounds will enhance the oxidation resistance of the coating and fill-in and close the surface defects.

Those skilled in the art will recognize that the coated article produced in accordance with the present invention will exhibit a service life in corrosive environments, such as that present in gas turbine engines, significantly longer than the same article which is conventionally plasma spray coated. Experiments have shown that the oxidation-corrosion resistance of the MCrAlY overlay coating of the present invention is at least comparable to that of vapor deposited coatings of the same composition. By utilizing a chromium, aluminum or similar metallic envelope during hot pressing and diffusing a portion or all of the envelope into the coating, the protective properties of the overlay coating can be further improved and varied as desired. Also, a plurality of individual envelopes deposited one upon the other may be employed if it is desired to further alter the overall coating properties.

Although the invention has been shown and described with respect to a preferred embodiment thereof, it should be understood by those skilled in the art that various changes and omissions in the form and detail thereof may be made therein without departing from the spirit and scope of the invention.

Having thus described a typical embodiment of our invention, that which we claim as new and desire to secure by Letters Patent of the United States is:

1. A method for coating a superalloy substrate with an oxidation-corrosion protective MCrAlY type coating where M is selected from the group consisting of nickel, cobalt and iron, comprising the steps of:

(a) plasma spraying the MCrAlY coating onto the superalloy substrate, the coating being characterized as having pores, voids and similar defects, some of which extend to the free surface of the coating, said defects reducing the protectiveness of the coating:

(b) sealing the free surface of the MCrAlY coating by providing a metallic envelope thereover, said envelope spanning and sealing the defects which extend to the free surface of the coating (c) hot isostatically pressing the coated substrate at a sufficient pressure and temperature and for a sufficient time to close the defects internal of the MCrAlY coating and those intersecting said free surface and to diffuse at least a portion of the metallic envelope into the MCrAlY coating, closure of said defects and diffusion of said metal envelope into the coating significantly enhancing the oxidation-corrosion protective properties of the coating.

2. The method of claim 1 wherein the metallic coating is aluminum.

3. The method of claim 1 wherein the metallic coating is chromium.

4. The method of claim 1 wherein the metallic envelope is provided by wrapping metallic foil thereon.

5. The method of claim 4 wherein the foil is aluminum foil.

6. The method of claim 1 wherein the metallic envelope is provided by electroplating the free surface to deposit a metallic coating thereon.

* * * * *

Disclaimer 4,152,223.—*Francis J. Wallace*, Windsor; *Norman S. Bornstein*, West Hartford and *Michael A. DeCrescente*, Wethersfield, Conn. PLASMA SPRAYED MCrAlY COATING AND COATING METHOD. Patent dated May 1, 1979. Disclaimer filed Feb. 17, 1981, by the inventors, the assignee, *United Technologies Corporation*, consenting.

Hereby enters this disclaimer to claims 1, 2 and 6 of said patent.

[*Official Gazette March 31, 1981.*]